US006490974B1

(12) United States Patent
Wadlinger et al.

(10) Patent No.: US 6,490,974 B1
(45) Date of Patent: Dec. 10, 2002

(54) SHEET-GUIDING DEVICE FOR A SHEET-FED PRINTING MACHINE

(75) Inventors: Ralf Wadlinger, Heidelberg (DE); Werner König, Mannheim (DE); Rudolf Leib, Wiesloch (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 45 days.

(21) Appl. No.: 09/666,950

(22) Filed: Sep. 20, 2000

(30) Foreign Application Priority Data

Sep. 20, 1999 (DE) ..... 199 44 937

(51) Int. Cl.[7] ..... B41F 13/24
(52) U.S. Cl. ..... 101/232; 101/216
(58) Field of Search ..... 101/230, 232, 101/183, 184, 185, 216, 229

(56) References Cited

U.S. PATENT DOCUMENTS

| | | | | |
|---|---|---|---|---|
| 5,787,810 A | * | 8/1998 | Stephan | 101/232 |
| 5,791,247 A | * | 8/1998 | Kolb | 101/147 |
| 6,302,021 B1 | * | 10/2001 | Wadlinger | 101/216 |
| 6,308,620 B1 | * | 10/2001 | Wadlinger et al. | 101/183 |

FOREIGN PATENT DOCUMENTS

| | | | |
|---|---|---|---|
| DE | 4318777 | C2 | 4/1996 |
| DE | 29702626 | U1 | 5/1997 |
| DE | 29721185 | U1 | 2/1998 |
| DE | 19603666 | C2 | 6/1998 |
| DE | 19719624 | C1 | 7/1998 |
| DE | 19752492 | A1 | 6/1999 |
| DE | 19753089 | A1 | 6/1999 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

A sheet-guiding device has a sheet-guiding element for a sheet-fed printing machine having an impression cylinder and a further cylinder adjacent thereto, the sheet-guiding element being disposed for guiding a sheet transported by the impression cylinder when the further cylinder is set-off from the impression cylinder. The further cylinder includes a cylinder selected from the group thereof consisting of an applicator cylinder for applying ink or varnish, respectively, to a sheet lying on the impression cylinder, and a tool cylinder for applying a finishing step to a sheet lying on the impression cylinder. The sheet-guiding element is disposed separately from the further cylinder and covers an impression zone of the impression cylinder.

12 Claims, 4 Drawing Sheets

SHEET-GUIDING DEVICE FOR A SHEET-FED PRINTING MACHINE

BACKGROUND OF THE INVENTION

Field of the Invention

The invention relates to a sheet-guiding device for a sheet-fed printing machine, more particularly, including an impression cylinder and a further cylinder adjacent thereto, the sheet-guiding device having a sheet-guiding element arranged for guiding a sheet transported by the impression cylinder when the further cylinder is set off or disengaged from the impression cylinder.

The published German Patent Document DE 431 87 77 C2 describes such a sheet-guiding device, which includes two blast-air tubes of which one is arranged in a wedge-shaped space upline of the printing zone, and the other is arranged in a wedge-shaped space downline of the printing zone of a printing unit that is not involved in printing. Although blast-air tubes arranged outside the printing zone and separately from a blanket cylinder can possibly be used to prevent thin paper sheets from striking the blanket cylinder not included in the in-line process in the region of the printing zone, this cannot be assured for pasteboard or cardboard sheets which are to be processed. There is therefore the risk that the board sheets, because of the stiffness thereof, cannot be kept at a distance from the blanket cylinder by the blast-air tubes in the region of the printing zone and will strike the blanket cylinder, due to which the fresh printed image on the sheets is smeared.

In the German Patent 197 19 624, a further sheet-guiding device is described which corresponds to the generic type thereof mentioned at the introduction hereto and wherein a sheet-guiding element is provided in the cylinder gap of a rubber blanket cylinder or varnishing blanket cylinder and covers the printing zone, as is shown in the drawings of the German patent. In an embodiment of the sheet-guiding element realized as a guide plate or tongue, although the rear or trailing edge of the sheet is able to slide along the sheet-guiding element without damaging the imprint or overprint when stiff sheets of board are being printed, sufficient free space is required in order to integrate the sheet-guiding element into the cylinder gap. The free space is generally not available, because the blanket clamping devices, which are arranged in the cylinder gap, themselves take up a great deal of space. For this reason, retrofitting of the sheet-guiding element to printing machines which are already in use is not possible.

In the published German Patent Document DE 196 03 666 C2, there is further described, as prior art, a safety guard device having a guard member which is pivotable into an interspace between a plate cylinder and a transfer cylinder in order to ensure effective protection during a non-stop printing-plate exchange. The safety guard device is provided for a web-fed printing machine, and the interspace is not located in the region of a printing zone of an impression cylinder.

SUMMARY OF THE INVENTION

Accordingly, it is an object of the invention to provide a sheet-guiding device by which trouble-free passage of freshly printed or varnished sheets of cardboard or pasteboard through a unit not directly involved in the in-line process is ensured.

With the foregoing and other objects in view, there is provided, in accordance with one aspect of the invention, a sheet-guiding device with a sheet-guiding element for a sheet-fed printing machine having an impression cylinder and a further cylinder adjacent thereto, the sheet-guiding element being disposed for guiding a sheet transported by the impression cylinder when the further cylinder is set-off from the impression cylinder, the further cylinder comprising a cylinder selected from the group thereof consisting of an applicator cylinder for applying one of ink and varnish, respectively, to a sheet lying on the impression cylinder, and a tool cylinder for applying a finishing step to a sheet lying on the impression cylinder, the sheet-guiding element being disposed separately from the further cylinder and covering an impression zone of the impression cylinder.

In accordance with another feature of the invention, the sheet-guiding element has at least one of a sheet-sliding and a blower nozzle face directed towards the impression cylinder, the face extending over the impression zone, at least approximately concentrically with the peripheral surface of the impression cylinder.

In accordance with a further feature of the invention, the sheet-guiding element has at least one of a sheet-sliding and a blower nozzle face directed towards the impression cylinder, the face extending over the impression zone, at least approximately parallel to a tangential line extending to the impression cylinder through the impression zone.

In accordance with an added feature of the invention, the sheet-guiding element extends through a nip formed in the region of the impression zone between the impression cylinder and the further cylinder.

In accordance with an additional feature of the invention, the nip has a nip width determined by a position of the further cylinder wherein it is withdrawn from the impression cylinder, and wherein a drive gear of the impression cylinder and a drive gear of the further cylinder are out of meshing engagement with one another.

In accordance with yet another feature of the invention, the nip has a nip width enlarged by an alignment therewith of a cylinder gap of the further cylinder facing towards the rotating impression cylinder, and including a security device for securing the further cylinder against rotation out of the aligned rotary position thereof.

In accordance with yet a further feature of the invention, the impression cylinder and the further cylinder are formed with respective peripheral circular arcs having a minimum spacing therebetween which is less than one tenth of a meter.

In accordance with an alternative feature of the invention, the impression cylinder and the further cylinder are formed with respective peripheral circular arcs having a minimum spacing therebetween which is less than one centimeter.

In accordance with yet an added feature of the invention, the sheet-guiding device includes a mounting for mounting the sheet-guiding element so that the sheet-guiding element is movable into the nip.

In accordance with yet an additional feature of the invention, the mounting is constructed so that the sheet-guiding element is insertable into the nip at least approximately tangentially to the impression cylinder.

In accordance with still another feature of the invention, the mounting is-constructed so that the sheet-guiding element is pivotable into the nip at least approximately coaxially with the impression cylinder.

In accordance with another alternative feature of the invention, the mounting is constructed so that the sheet guide element is pivotable into the nip at least approximately coaxially with the further cylinder.

In accordance with still a further feature of the invention, the sheet-guiding device includes a remotely controllable actuator connected to the sheet-guiding element for displacing the sheet-guiding element into and out of the nip.

In accordance with still an added feature of the invention, the actuator is connected to the further cylinder for displacing the further cylinder into a position wherein it is withdrawn from the impression cylinder.

In accordance with a concomitant aspect of the invention, there is provided a sheet-fed printing machine having a sheet-guiding device constructed with at least one of the foregoing features.

Thus, the further cylinder cooperating with the impression cylinder and serving as the applicator cylinder can be a blanket cylinder or a varnishing blanket cylinder or a printing-form or varnishing-form cylinder and, when serving as the tool cylinder, can be a stamping, embossing, creasing or perforating cylinder. The impression zone extends axially parallel on the peripheral surface of the impression cylinder.

The impression zone is normally also referred to as the printing zone or line if the impression zone is formed with the applicator cylinder. An impression zone formed with the tool cylinder can be referred to as the contact zone or line, within the area of which the processing of the sheet located between the cylinders takes place. The sheet-guiding element is not applied to the further cylinder, as is provided in the aforementioned published German Patent Document DE 197 19 624 C1, but rather, in contrast with the latter, is applied separately from the further cylinder so that it can move on the sheet-fed printing machine and, for example, on the frame of the latter. As viewed in the radial direction of the impression cylinder, the sheet-guiding element is located directly above the impression zone thereof, so that the sheet conveyed through the inactive printing, varnishing or processing unit cannot strike the further cylinder with a sheet trailing edge within the region that is critical due to the proximity of the further cylinder to the impression cylinder, because the sheet-guiding element is located between the further cylinder and the sheet. Acting as a spacer, this prevents the sheet from coming into contact with the further cylinder during the passage thereof through the inactive unit.

Assurance is therefore always provided that the ink (varnish) previously applied to the sheet in at least one printing unit (varnishing unit) disposed upline of the inactive unit in the in-line process does not come into contact with the further cylinder and, therefore, not smeared thereby.

Other features which are considered as characteristic for the invention are set forth in the appended claims.

Although the invention is illustrated and described herein as embodied in a sheet-guiding device for a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
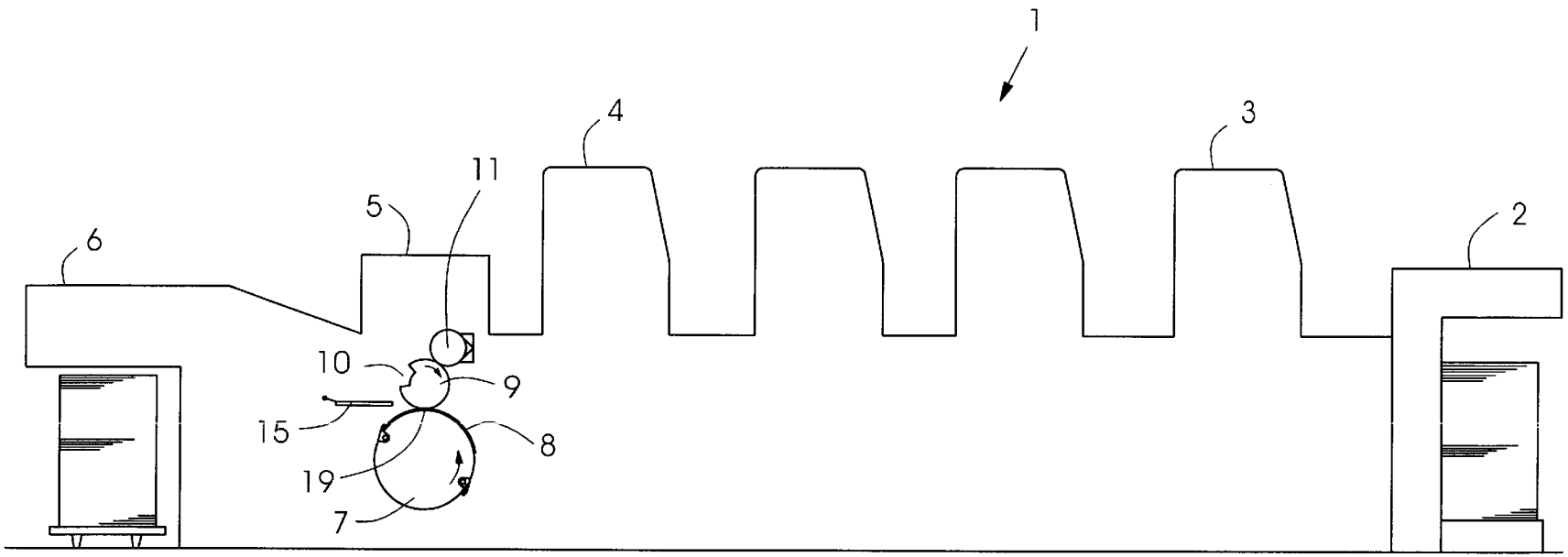
FIG. 1 is a diagrammatic side elevational view of a sheet-fed printing machine having several printing units, and a varnishing unit with a sheet-guiding device disposed downline therefrom.

Referring now to the drawings and, first, particularly to FIG. 1 thereof, there is shown therein a printing machine 1 formed as a rotary printing machine and having a sheet feeder 2, a number of printing units 3 and 4 formed as offset printing units, a unit 5 arranged downline of the printing unit 4 in the sheet transport direction, and a sheet delivery 6, the unit 5 including an impression cylinder 7 having a peripheral surface whereon there rests a sheet 8 that is held in grippers belonging to the impression cylinder 7, the sheet 8 being acted upon by a further cylinder 9 in a region of an impression zone 19 of the cylinder 9. The cylinder 9 is formed with an axially parallel cylinder gap 10 into which the grippers of the impression cylinder 7 dip or penetrate from time to time, as the cylinders 7 and 9 roll on one another. The cylinder 9 is formed as an applicator cylinder, which receives varnish supplied by a metering device 11 including a screen or anilox roller and a chambered scale or balance, and applies the varnish to the sheet 8 in the region of the impression zone 19. Through the intermediary of the cylinder 9, which is displaced towards the impression cylinder 7 and set against the sheet 8, a multicolor image printed onto the sheet 8 in the printing units 3 and 4 can be covered with a protective varnish in the unit 5.

There are also print jobs, however, which, although requiring the sheet 8 to be printed in the printing units 3 and 4, do not require varnishing of the sheet 8 in the unit 5. In order to perform such print jobs, the cylinder 9 is displaced away from the impression cylinder 7 into a withdrawn position (note FIG. 2) wherein the cylinder 9 no longerengages the sheet 8 transported past the cylinder 9 by the impression cylinder 7.

A minimum spacing 12 (note FIG. 3) between the peripheral surface of the impression cylinder 7 and the peripheral surface of the cylinder 9 can be less than 10 cm, and especially less than 1 cm, in this so-called impression-off position but, nevertheless, can prove to be a sufficiently large nip 13 wherein a sheet-guiding element 14 belonging to a sheet-guiding device 15 assigned to the impression cylinder 7 is able to be displaced when the unit 5 is not involved in printing. In the aforementioned impression-off position, a gearwheel 16 applied coaxially to the cylinder 9 remains meshed with a gearwheel 17 applied coaxially to the impression cylinder 7. If the nip width 18 determined only by the impression-off position is not sufficiently large to accommodate the sheet-guiding element 14, the nip width 18 can be enlarged by rotating the cylinder 9 into a rotary position wherein the cylinder gap 10 is located opposite the impression zone 19. The cylinder gap 10 extends in the axial direction of the cylinder 9, at least over the length of the sheet-guiding element 14, and thus forms a flattening of the cylinder 9 which is beneficial for the insertion of the sheet-guiding element 14 into the nip 13. Through the intermediary of a securing device 20, the cylinder 9 can be locked in the rotary position thereof with the cylinder gap 10 suitably aligned. When the unit 5 is active (note FIG. 1), the gearwheel 17 drives the gearwheel 16, and the latter rotatively drives the cylinder 9. If the gearwheels 16 and 17 intermesh when the cylinder gap 10 is aligned (note FIG. 2), a clutch 21 serving to connect the gearwheel 16 to the cylinder 9 can be disengaged, so that the rotational movement of the gearwheel 16 is no longer transmitted to the cylinder 9.

In order to produce a sufficiently large nip width 18, the cylinder 9 can also be displaced away from the impression cylinder 7 to such an extent that the gearwheel 16 comes out of engagement with the gearwheel 17 because of the amount of the displacement. In the event of such a large displacement of the cylinder 9 away from the impression cylinder 7, it is often unnecessary to keep the cylinder gap 10 in alignment facing towards the impression cylinder 7, and the spacing 12 between the peripheral outlines of the two cylinders 7 and 9, which results from the large displacement, is sufficient for the insertion of the sheet-guiding element 14 into the nip 13. If the gearwheels 16 and 17 are brought out of engagement, the presence of the clutch 21 is unnecessary, even if the cylinder gap 10 is to be kept in the aligned position by the securing device 20 for the purpose of additionally enlarging the nip width 18.

FIGS. 3 to 7 show various mechanisms by which the sheet-guiding element 14 is movable into and out of the nip 13. These mechanisms can be used regardless of whether the nip width 18 is determined by uncoupling the drive to the cylinders 7 and 9 and/or the alignment of the cylinder gap 10, or only by the impression-off position. It is also immaterial whether the displacement of the cylinder 9 away from the impression cylinder 7 in order to produce the free space between the cylinders 7 and 9 is performed in a radial direction extending through the impression zone 19, or a tangential direction of the impression cylinder 7 extending through the impression zone 19, or a tangential direction extending between the aforementioned directions.

Figure 3:
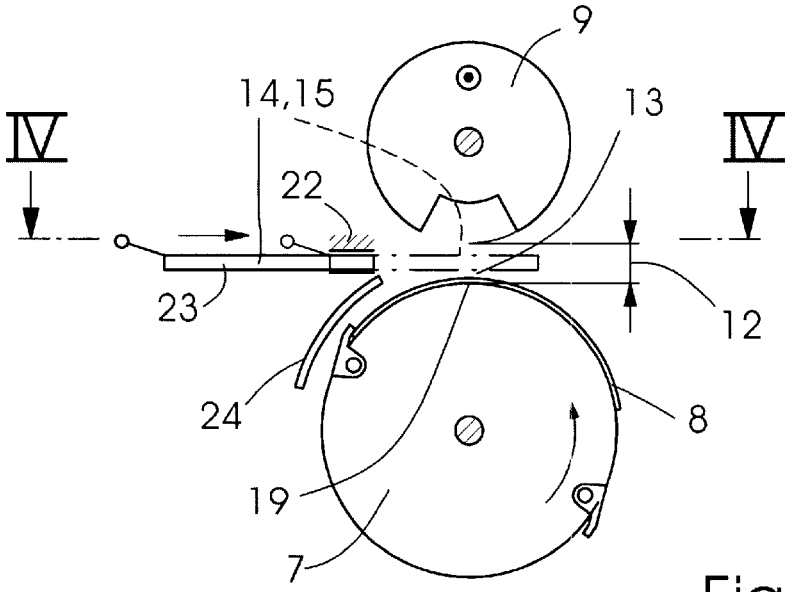
FIG. 3 is a cross-sectional view of FIG. 2 taken along the line III—III in the direction of the arrows and showing the impression cylinder, the sheet-guiding element assigned thereto and the applicator cylinder, all in a front elevational view.
Figure 4:
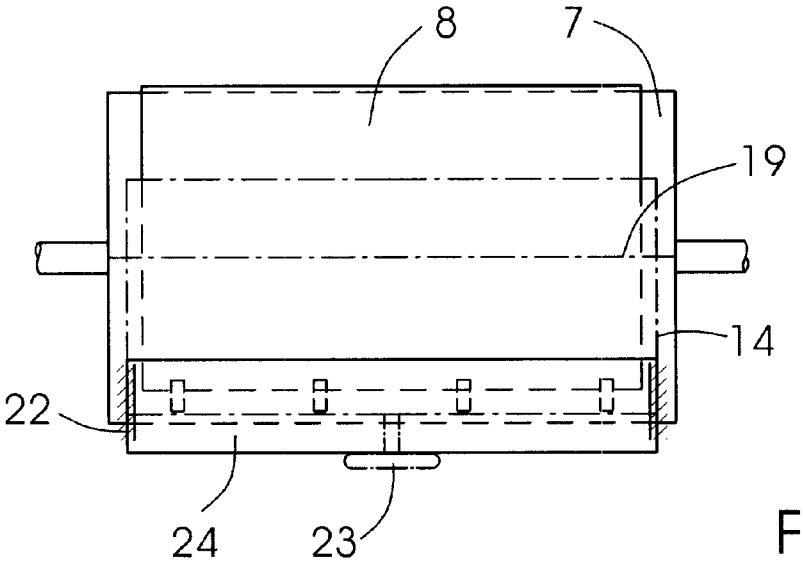
FIG. 4 is a cross-sectional view of FIG. 3 taken along the line IV—IV in the direction of the arrows and showing the sheet-guiding element and the impression cylinder in a plan view.

In the embodiment of the sheet-guiding device 15 according to FIG. 3, a mounting 22 formed as a linear guide, for example, a groove or rail, is provided for the sheet-guiding element 14, the sheet-guiding element 14 being displaceable along the mounting 22 from the position of the sheet-guiding element 14 outside the nip 13, i.e., the position thereof represented by solid lines, into a position thereof which is represented in phantom and wherein the sheet-guiding element 14 covers the impression zone 19 (note FIG. 4). In order to move the sheet-guiding element 14 into and out of the nip 13, a handle 23 is provided on the sheet-guiding element 14 of FIG. 4. Such a handle 23 can also be provided on the pivotable sheet-guiding elements 14 shown in FIGS. 5 and 7. The sheet-guiding elements 14 shown in FIGS. 3 and 7 can also, however, be displaced into and out of the nip 13 by a remotely controllable actuator, for example, by a lifting-piston cylinder. When the sheet-guiding element 14 illustrated in FIG. 3 is located in the operating position thereof shown in phantom within the nip 13, with a spacing to the cylinder 9 and to the impression cylinder 7, a further sheet-guiding element 24 immediately adjoins the sheet-guiding element 14 in the sheet transport direction of the impression cylinder 7, represented in FIG. 3 by a horizontal arrow.

Figure 2:
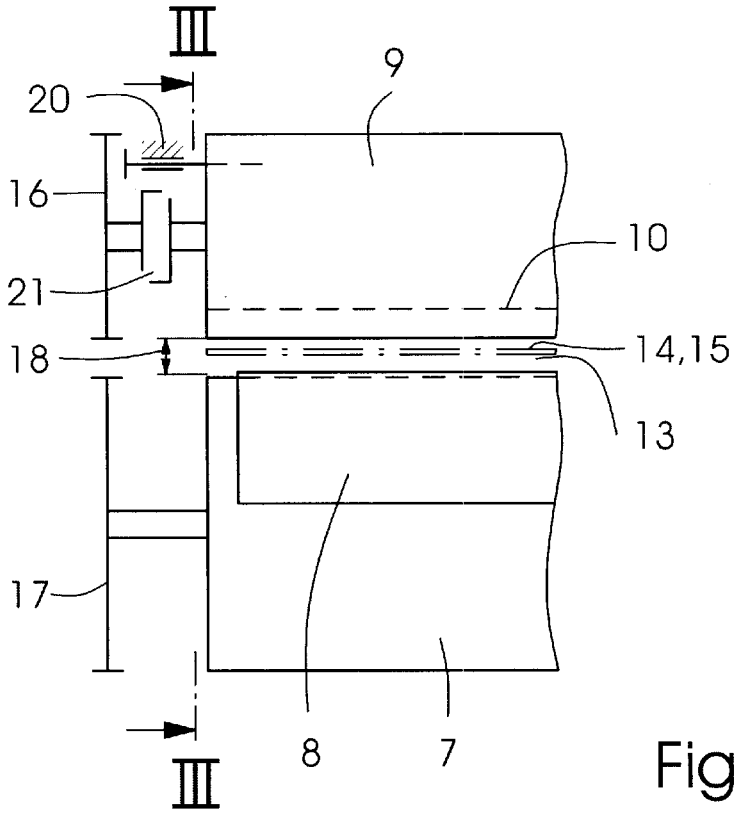
FIG. 2 is an enlarged fragmentary front elevational view of FIG. 1 showing an impression cylinder and an applicator cylinder of the varnishing unit and a sheet-guiding element of the sheet-guiding device in a fragmentary side elevational view.
Figure 5:
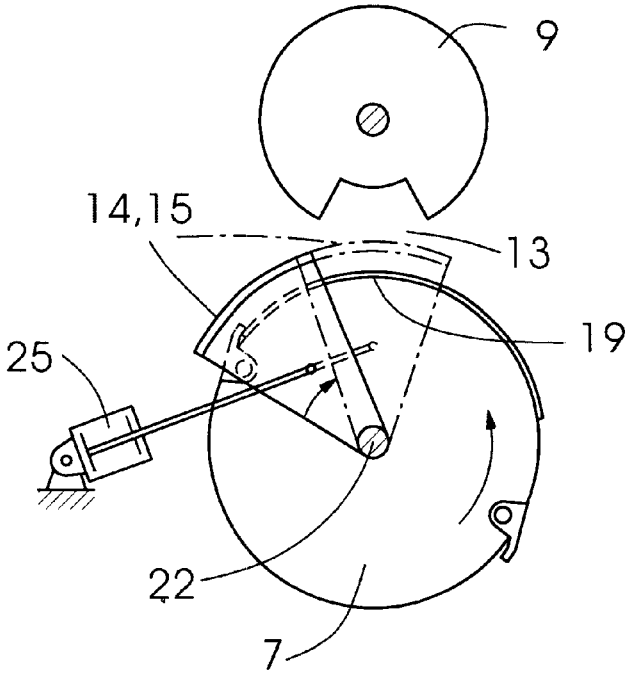
FIG. 5 is a view like that of FIG. 3 showing a further embodiment of the sheet-guiding device with a sheet-guiding element that is pivotable coaxially with the impression cylinder.

The sheet-guiding device 15 shown in FIG. 5 differs from the sheet-guiding device 15 shown in FIGS. 2 to 4 in that the sheet-guiding element 14 illustrated in FIG. 5 has an actuator 25 assigned thereto as an actuating drive, and in that the movement of the sheet-guiding element 14 into the nip 13 is performed in a non-linear direction. The mounting 22 is constructed here as a rotary joint which is arranged at least approximately coaxially with the axis of rotation of the impression cylinder 7, the sheet-guiding element 14 being pivotable about the mounting 22 into the nip 13 in the manner of a pivoting lever, so that the sheet-guiding element 14 covers the impression zone 19. Assigned to the sheet-guiding element 14 is an actuator 25, which is fixed articulatedly to the frame of the printing machine 1 and is constructed as a pneumatic lifting-piston cylinder. The actuator 25 and, more precisely, the piston rod thereof is attached to the sheet-guiding element 14, more precisely, to the side plate thereof. Depending upon which of the two chambers of the actuator 25 has the pressure fluid applied thereto, the actuator 25 moves out and pivots the sheet-guiding element 14 into the nip 13, or the actuator 25 moves in and draws the sheet-guiding element 14 out of the nip 13. In many cases, instead of the actuator 25, a handle comparable with the handle 23 (note FIG. 3) can also be applied to the sheet-guiding element 14 illustrated in FIG. 5, for the purpose of handling the sheet-guiding element 14 manually.

Figure 6:
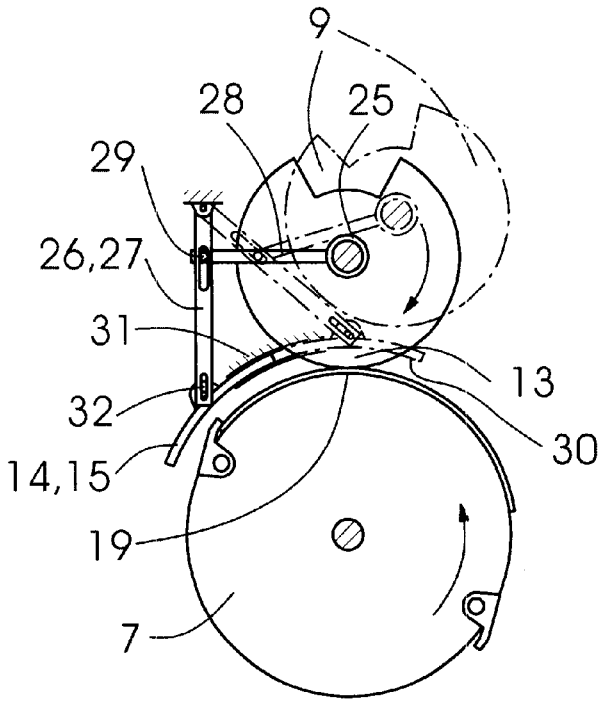
FIG. 6 is a view like those of FIGS. 3 and 5 showing another embodiment of the sheet-guiding device with a sheet-guiding element coupled to the applicator cylinder.

Whereas, in the embodiment according to FIG. 5, in addition to the actuator 25, there is a further actuator for displacing the cylinder 9 away from and towards the impression cylinder 7, the actuator 25 illustrated in FIG. 6 is used both for displacing the sheet-guiding element 14 and the cylinder 9. A transmission mechanism 26 coupling the sheet-guiding element 14 to the cylinder 9 includes a pivoting lever 27 and a coupling bar 28. At one end of the pivoting lever 27, the latter is fixed to the frame of the printing machine 1 by a rotary joint and, at the other end, it is connected to the sheet-guiding element 14 by a rotary joint. The coupling bar 28 is connected at one end thereof to the pivoting lever 27 via a joint 29, and at the other end thereof to the cylinder 9. The joint 29 is both a rotary joint, which permits a change in the angular position of the coupling bar 28 relative to the pivoting lever 27, and a thrust joint, which guides the coupling bar 28 in the longitudinal direction of the pivoting lever 27. At the same time as the cylinder 9 is displaced by the actuator 25 into the position withdrawn from the impression cylinder 7, the same actuator 25 causes a displacement of the sheet-guiding element 14 into the nip 13, the sheet-guiding element 14 being pivoted about the rotary joint belonging to the pivoting lever 27 and fixed to the frame. The sheet-guiding element 14 illustrated in FIG. 6 is constructed as a blowing device, which expels blown or blast-air jets directed towards the sheet 8 and keeps the latter away from the cylinder 9 and on the impression cylinder 7. A face 30 of the sheet-guiding element 14, which is directed towards the impression cylinder 7, can be provided with the blower nozzles expelling the blast-air jets, can be constructed to permit the sheet trailing edge to slide along on the face 30, or can be constructed both as a sheet sliding face and also a blower nozzle face. The sheet-guiding element 14 can be formed as a guide plate, guide bracket or guide rake and as a blower box, blower bracket or blower rake or as a blowing guide bracket or guide rake. All the embodiments of the sheet-guiding element as a sliding and/or blowing element, which are mentioned hereinabove in connection with the sheet-guiding element 14 illustrated in FIG. 6, can also be provided in the construction of the sheet-guiding elements 14 illustrated in the other figures.

Figure 7:
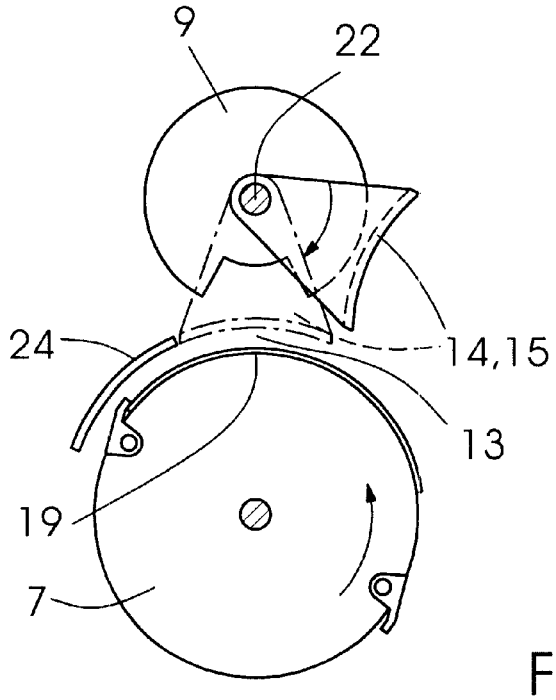
FIG. 7 is a view like those of FIGS. 3, 5 and 6 showing yet a further embodiment of the sheet-guiding device with a sheet-guiding element that is pivotable coaxially with the applicator cylinder.

In the embodiment of the sheet-guiding device 15 illustrated in FIG. 7, the mounting 22 is constructed as a rotary joint which is somewhat coaxial with the cylinder 9, about which the sheet-guiding element 14 is pivotable in and out of the nip 13. The sheet-guiding element 14 illustrated in FIG. 7 can have an actuator assigned thereto, which is comparable with the actuator 25 shown in FIG. 5, or a handle comparable with the handle 23 shown in FIG. 3.

With regard to the displacement of the cylinder 9 illustrated in FIGS. 5 to 7 into the position thereof withdrawn from the impression cylinder 7, that which has been stated hereinbefore with regard to the cylinder 9 shown in FIGS. 2 to 4 in terms of separating the drive and aligning the cylinder gap 10, applies as well thereto. In FIGS. 1 to 7, functionally identically acting parts, respectively, have been identified by the same reference numerals so as to provide an improved understanding of the invention.

We claim:

1. In combination with a sheet-fed printing machine having an impression cylinder and a further cylinder adjacent thereto, the further cylinder being a cylinder selected from the group thereof consisting of an applicator cylinder for applying one of ink and varnish, respectively, to a sheet lying on the impression cylinder, and a tool cylinder for applying a finishing step to a sheet lying on the impression cylinder, a sheet-guiding device comprising;

a sheet-guiding element disposed for guiding a sheet transported by the impression cylinder when the further cylinder being set-off from the impression cylinder, said sheet-guiding element extending through a nip formed in the region of an impression zone of the impression cylinder between the impression cylinder and the further cylinder, said sheet-guiding element being disposed separately from the further cylinder and covering the impression zone of the impression cylinder;

the impression cylinder and the further cylinder being formed with respective peripheral circular arcs having a minimum spacing therebetween, the spacing being less than ten centimeters.

2. The sheet-guiding device according to claim 1, wherein the sheet-guiding element has at least one of a sheet-sliding and a blower nozzle face directed towards the impression cylinder, said face extending over the impression zone, at least approximately concentrically with the peripheral surface of the impression cylinder.

3. The sheet-guiding device according to claim 1, wherein the sheet-guiding element has at least one of a sheet-sliding and a blower nozzle face directed towards the impression cylinder, said face extending over the impression zone, at least approximately parallel to a tangential line extending to the impression cylinder through the impression zone.

4. The sheet-guiding device according to claim 1, wherein said nip has a nip width determined by a position of the further cylinder wherein it is withdrawn from the impression cylinder, and wherein a drive gear of the impression cylinder and a drive gear of the further cylinder are out of meshing engagement with one another.

5. The sheet-guiding device according to claim 1, wherein said nip has a nip width enlarged by an alignment therewith of a cylinder gap of the further cylinder facing towards the rotating impression cylinder, and including a security device for securing the further cylinder against rotation out of the aligned rotary position thereof.

6. The sheet-guiding device according to claim 1, wherein the impression cylinder and the further cylinder are formed with respective peripheral circular arcs having a minimum spacing therebetween which is less than one centimeter.

7. The sheet-guiding device according to claim 1, including a mounting for mounting the sheet-guiding element so that the sheet-guiding element is movable into said nip.

8. The sheet-guiding device according to claim 7, wherein said mounting is constructed so that the sheet-guiding element is insertable into said nip at least approximately tangentially to the impression cylinder.

9. The sheet-guiding device according to claim 7, wherein said mounting is constructed so that the sheet-guiding element is pivotable into said nip at least approximately coaxially, with the impression cylinder.

10. The sheet-guiding device according to claim 7, wherein said mounting is constructed so that the sheet-guiding element is pivotable into said nip at least approximately coaxially with the further cylinder.

11. The sheet-guiding device according to claim 1, including a remotely controllable actuator connected to the sheet-guiding element for displacing the sheet-guiding element into and out of said nip.

12. The sheet-guiding device according to claim 11, wherein said actuator is connected to the further cylinder for displacing the further cylinder into a position withdrawn from the impression cylinder.

* * * * *